US011564495B1

(12) United States Patent
Arnett

(10) Patent No.: US 11,564,495 B1
(45) Date of Patent: Jan. 31, 2023

(54) ADJUSTABLE AND ANGLED SEAT ASSEMBLY

(71) Applicant: NuChair, Inc., Pompano Beach, FL (US)

(72) Inventor: Michael Arnett, Pompano Beach, FL (US)

(73) Assignee: Nuchair Inc., Lauderdale by the Sea, FL (US)

( * ) Notice: Subject to any disclaimer, the term of this patent is extended or adjusted under 35 U.S.C. 154(b) by 0 days.

(21) Appl. No.: 17/467,626

(22) Filed: Sep. 7, 2021

(51) Int. Cl.

| | |
|---|---|
| ***A47C 9/02*** | (2006.01) |
| ***A47C 3/026*** | (2006.01) |
| ***A47C 7/00*** | (2006.01) |
| ***A47C 7/02*** | (2006.01) |
| ***A47C 1/032*** | (2006.01) |
| ***A47C 1/023*** | (2006.01) |
| ***A47C 3/40*** | (2006.01) |

(52) U.S. Cl.
CPC ..... *A47C 1/032* (2013.01); *A47C 1/023* (2013.01); *A47C 3/40* (2013.01); *A47C 7/004* (2013.01)

(58) Field of Classification Search
CPC ..... A47C 1/023; A47C 1/0325; A47C 3/40; A47C 7/00; A47C 9/005
USPC ..... 297/423.11, 423.12, 423.13
See application file for complete search history.

(56) References Cited

U.S. PATENT DOCUMENTS 4,832,407 A * 5/1989 Serber ..... A47C 9/005 297/423.12
5,054,857 A * 10/1991 Kvalheim ..... A47C 13/00 297/423.12 X
5,295,728 A 3/1994 Schaevilz
5,330,248 A 7/1994 Smyly et al.
5,487,590 A 1/1996 Haynes
5,720,517 A 2/1998 Prothro, Sr.
6,065,808 A 5/2000 Tinsley
6,595,589 B2 7/2003 Cochran
6,619,747 B2 * 9/2003 Ko ..... A47C 9/025 297/411.31
6,698,831 B2 3/2004 Lloyd
(Continued)

FOREIGN PATENT DOCUMENTS

DE 3625250 A * 2/1987 ..... A47C 7/02
DE 3903388 A1 * 8/1990 ..... A47C 9/005
(Continued)

*Primary Examiner* — Rodney B White
(74) *Attorney, Agent, or Firm* — Mark C. Johnson; Johnson Dalal

(57) ABSTRACT

An adjustable and angled seat assembly having a base supportable on a ground surface, a wedge support member with a wedge length separating the front and rear ends thereon and a wedge height separating upper and lower ends thereon, with the lower end directly coupled to a support plate and tapering in the wedge height spanning along the wedge length to define a wedge angle θ defined by the upper and lower ends of the wedge support member. The assembly also includes a seat cushion having a seat-support surface disposed above the base and a seat-support angle relative to the base support plane and a lower surface directly coupled to the upper 704 of the wedge support member and a chest cushion having a chest-support surface disposed above the seat-support surface, coupled to the support plate, and disposed at an at an acute angle with respect to the seat-support surface.

19 Claims, 9 Drawing Sheets

(56) References Cited

U.S. PATENT DOCUMENTS

| | | | | |
|---|---|---|---|---|
| 6,729,690 | B2 | 5/2004 | Roleder et al. | |
| 7,234,768 | B2 * | 6/2007 | Manning | A47C 9/02 297/97 |
| 8,702,162 | B2 | 4/2014 | Isaacson | |
| 9,084,486 | B1 * | 7/2015 | Richardson | A47C 7/004 |
| 9,451,831 | B2 * | 9/2016 | Richardson | A47C 7/006 |
| 9,814,313 | B2 * | 11/2017 | Richardson | A47C 7/543 |
| 10,506,881 | B2 * | 12/2019 | Richardson | A47C 7/543 |
| 10,524,573 | B2 * | 1/2020 | Richardson | A47C 9/02 |
| 2005/0127737 | A1 * | 6/2005 | Kobayashi | A47C 9/005 297/423.12 |
| 2007/0052275 | A1 | 3/2007 | Ghilzai | |
| 2008/0143164 | A1 * | 6/2008 | Ghilzai | A47C 1/11 297/423.12 |
| 2010/0295357 | A1 * | 11/2010 | Koehler | A47C 9/005 297/463.1 |
| 2015/0189992 | A1 | 7/2015 | Richardson et al. | |
| 2016/0073786 | A1 * | 3/2016 | Walker | A47C 9/002 297/325 |
| 2016/0157618 | A1 * | 6/2016 | Arnett | A47C 9/002 297/325 |
| 2019/0223603 | A1 | 7/2019 | France | |

FOREIGN PATENT DOCUMENTS

| | | | | | |
|---|---|---|---|---|---|
| JP | 2006314484 | A | * | 11/2006 | A47C 7/503 |
| JP | 2011224372 | A | * | 11/2011 | A47C 7/503 |
| JP | 5108130 | B2 | * | 12/2012 | A47C 7/503 |
| JP | 2013165955 | A | * | 8/2013 | A47C 7/503 |
| WO | WO008606940 | A1 | | 4/1986 | |
| WO | WO-2011003215 | A2 | * | 1/2011 | A47C 9/005 |
| WO | WO-2021018655 | A1 | * | 2/2021 | A47C 7/029 |

* cited by examiner

ADJUSTABLE AND ANGLED SEAT ASSEMBLY

FIELD OF THE INVENTION

The present invention relates generally to ergonomic chairs suitable for home or office use, and, more particularly, relates to an adjustable and angled seat assembly that provides multiple seating positions for a user that relieves or avoids back and other body pain experienced by the user.

BACKGROUND OF THE INVENTION

Adjustable chairs are known in various therapeutic settings. However, such chairs are configured for use by a primary user intended to receive therapy, as well as, use by a secondary user intended to provide said therapy to the primary user. Accordingly, adjustment features and controls are often positioned so as to provide access to the secondary user who is in control of positioning the primary user. In addition, such chairs are not designed specifically to provide ergonomic benefits to the primary user that addresses prolonged use by the primary user on a day-to-day basis. Stated another way, such therapeutic chairs are not designed for users to use on a daily basis for several hours as a work chair for home or office use. Therapeutic chairs are specifically designed for limited use by therapy patients and not for continued daily use. On the contrary, chairs designed for such daily and/or prolonged use in the home or office should preferably provide support for body parts that may be potentially stressed over prolonged periods of sitting and efficient access and operation for single occupant-users.

Another drawback of adjustable therapeutic chairs is that they include arm, leg, and/or facial rest surfaces that obstruct the user's view or vocalization and therefore could not be functionally used with a desk in order to work, type on a keyboard, conduct telephone conversations or video conferences, view computer display screens, and the like.

Other types of adjustable chairs exist that allow a user to selectively adjust various chair members as desired by the user. However, these types of adjustable chairs do not provide fixed positioning of certain chair members, such as a seat and a chest support, in order to ensure that the user is seated in an optimally ergonomic position to properly support the user's spine. Advantageously, this would ensure proper spine support for the user, even if the user is ignorant as to the most optimal spine support sitting position. Furthermore, many known ergonomic chairs have a lumbar support, which help create a good ergonomic position for the spine. However, these known chairs require the user to lean back away from their workplace in order to create the spine alignment, while also angling the hips/pelvis at an optimal angle as when standing.

Furthermore, those known therapeutic and/or ergonomic chairs fail to provide users with a structurally secure seat assembly capable of maintaining an angled seat position with a user's body weight thereon.

Therefore, a need exists to overcome the problems with the prior art as discussed above.

SUMMARY OF THE INVENTION

The invention provides an adjustable seating assembly that overcomes the herein aforementioned disadvantages of the heretofore-known devices and methods of this general type and that provides multiple seating positions for a user that avoids back and other body pain experience by the user.

With the foregoing and other objects in view, there is provided, in accordance with the invention, an adjustable and angled seat with a base having a support plate of a substantially rigid material and having a vertical support leg rotatably coupled to the support plate and with a plurality of horizontal supports legs coupled to the vertical support leg and each having a wheel rotatably coupled thereto and defining a base support plane and a wedge support member of a substantially rigid material, with a front end, a rear end opposing the front end of the wedge support member, a wedge length separating the front and rear ends of the wedge support member, an upper end, a lower end opposing the upper end of the wedge support member, and a wedge height separating the upper and lower ends, wherein the lower end of the wedge support member is directly coupled to the support plate and tapering in the wedge height spanning along the wedge length to define a wedge angle θ defined by the upper and lower ends of the wedge support member. The assembly also includes a seat cushion member having a seat-support surface disposed above the base and a seat-support angle relative to the base support plane and having a lower surface opposing the seat-support surface and directly coupled to the upper end of the wedge support member and a chest cushion member having a chest-support surface disposed above the seat-support surface and coupled to the support plate, the chest-support surface disposed at an acute angle with respect to the seat-support surface.

In accordance with another feature of the present invention, the vertical support leg further comprises a plurality of telescopically connected leg components selectively vertically adjustable to one another with a lever coupled to the support plate.

In accordance with another feature, an embodiment of the present invention also includes the wedge angle θ being substantially equal to the seat-support angle.

In accordance with yet another feature of the present invention, the cushion member and the chest cushion member are of a deformably resilient material.

In accordance with a further feature of the present invention, the chest cushion member is selectively adjustable in height relative to the seat-support surface with a chest support member and coupled to the support plate.

In accordance with an additional feature, an embodiment of the present invention also includes peripheral user-contact edges or points surrounding the seat-support surface and defining a seat plane and peripheral user-contact edges or points surrounding the chest-support surface and defining a chest plane, wherein the seat plane is orientated at an acute angle with respect to the chest plane.

In accordance with another feature, an embodiment of the present invention also includes the wedge support member having a bottom wedge wall spanning the wedge length and flanked by two side wedge walls disposed in an upright configuration with respect to the bottom wedge wall, spanning the wedge length, and defining the wedge length, wherein the bottom wedge wall and the two side wedge walls defining a wedge channel spanning the wedge length.

In accordance with another feature, an embodiment of the present invention also includes the wedge support member having a first cantilevered flange member extending outwardly from one of the two side wedge walls and a second cantilevered flange member extending outwardly from another of the two side wedge walls, wherein the first and second cantilevered flange members are disposed in a parallel and adjacent configuration with the lower surface of the seat cushion member and coupled thereto with a plurality of fasteners.

In accordance with an exemplary feature, an embodiment of the present invention also includes the support plate having an upper surface, the bottom wedge wall disposed in a parallel and adjacent configuration with the upper surface of the support plate and coupled thereto with a plurality of fasteners.

In accordance with another feature, an embodiment of the present invention also includes the support plate having a support front end, a support rear end opposing the support front end, and a support length separating the support front and rear ends, wherein the upper surface spans the support length and the bottom wedge wall is directly coupled to the upper surface along at least 75% of the support length.

Also in accordance with the present invention, an adjustable and angled seat assembly is disclosed that includes a base having a support plate of a substantially rigid material, a wedge support member with a front end, a rear end opposing the front end of the wedge support member, a wedge length separating the front and rear ends of the wedge support member, an upper end, a lower end opposing the upper end of the wedge support member, a wedge height separating the upper and lower ends, a bottom wedge wall spanning the wedge length and flanked by two side wedge walls disposed in an upright configuration with respect to the bottom wedge wall, spanning the wedge length, and defining the wedge length, the bottom wedge wall and the two side wedge walls defining a wedge channel spanning the wedge length, wherein the bottom wedge wall directly coupled to the support plate and tapering in the wedge height spanning along the wedge length to define a wedge angle θ defined by the upper and lower ends of the wedge support member. In additional embodiments, the seat cushion member has a seat-support surface disposed above the base and having a lower surface opposing the seat-support surface and directly coupled to the upper end of the wedge support member. The assembly also includes a chest cushion member having a chest-support surface disposed above the seat-support surface and coupled to the support plate, the chest-support surface disposed at an at an acute angle with respect to the seat-support surface.

Although the invention is illustrated and described herein as embodied in an adjustable and angled seat assembly, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, unless otherwise indicated herein, the term "longitudinal" should be understood to mean in a direction corresponding to an elongated direction of the adjustable seating assembly spanning from the base toward the chest support surface.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
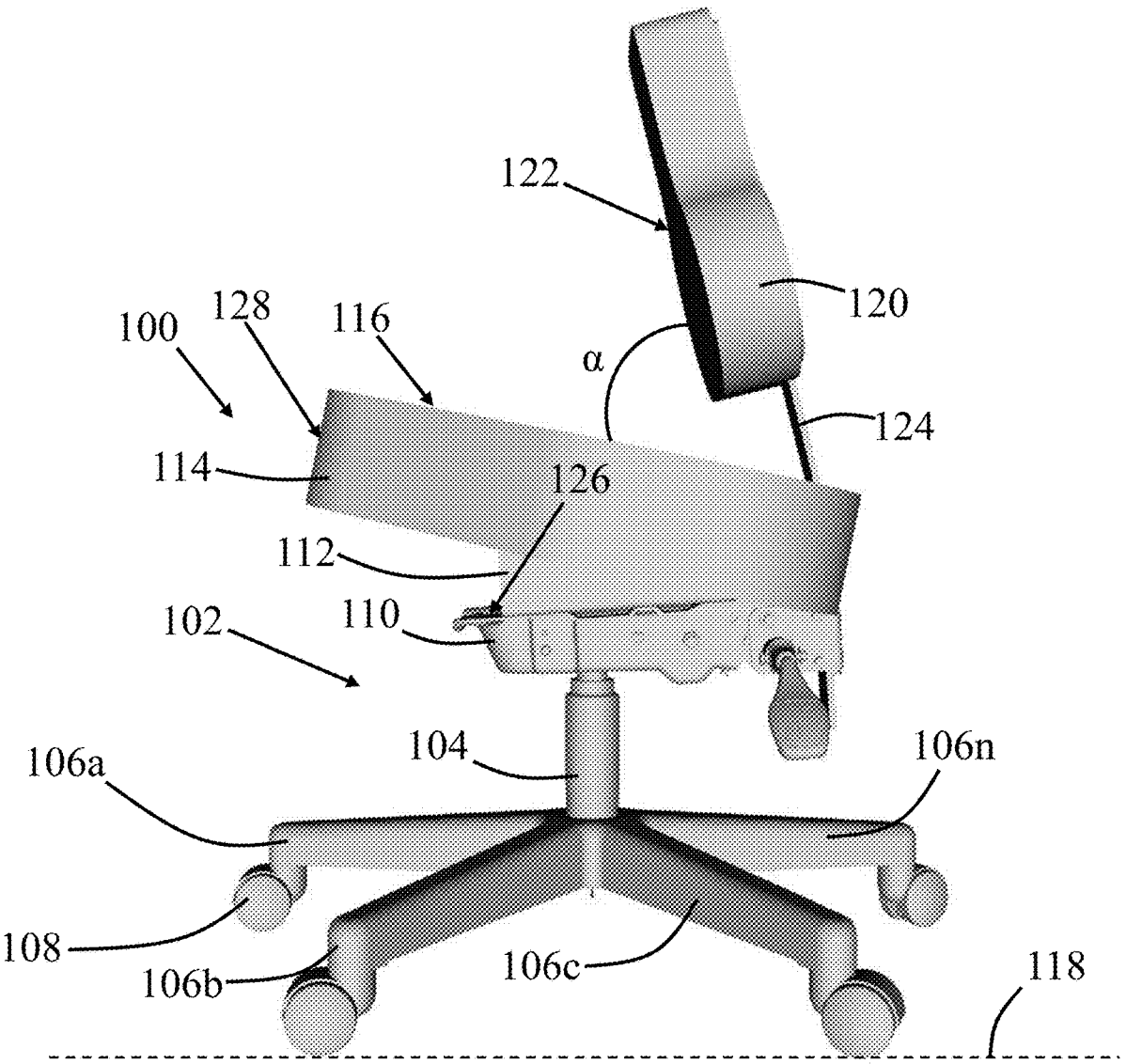
FIG. 1 is an elevational right-side view of an adjustable and angled seat assembly in accordance with one embodiment of the present invention.
Figure 2:
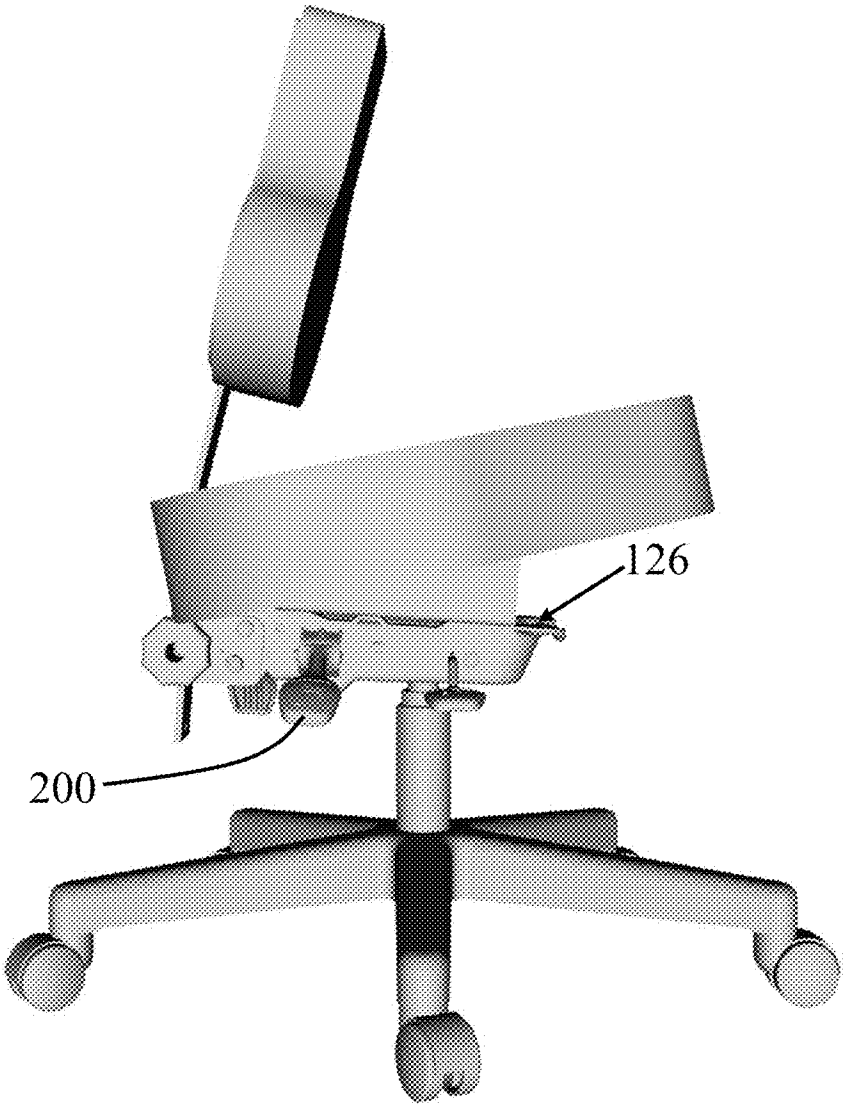
FIG. 2 is an elevational left-side view of the adjustable and angled seat assembly in FIG. 1.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient adjustable and angled seat assembly. Embodiments of the invention provide an adjustable and angled seat assembly with the ability effectively and efficiently maintain the acute angle between the seat support member and the chest support member. It should be noted that "chest" shall not be limiting in nature, as the support member may also support the stomach or abdomen of the user.

Referring now to FIG. 1, one embodiment of the present invention is shown in an elevational side view. FIG. 1 shows several advantageous features of the present invention, but, as will be described below, the invention can be provided in several shapes, sizes, combinations of features and components, and varying numbers and functions of the components. The first example of an adjustable and angled seat assembly 100, as shown in FIG. 1, includes a base 102 supporting the assembly 100 on a ground surface, a seat-support surface 118, and a chest-support surface 122.

The seat-support surface 116 and the chest-support surface 122 can be seen as defining a chest-supported seating area for a user. Specifically, the seat-support surface 116 may be described as having peripheral user-contact points or edges e.g., edges 600 (best depicted in FIG. 6), surrounding the seat-support surface 116 and defining a seating plane. Similarly, the chest-support surface 122 may also be described as having peripheral user-contact points or edges, e.g., edges 314 (depicted best in FIG. 3), surrounding the chest-support surface 122 and defining a chest plane. The planes defined thereon are, as the name implies, planar and are defined by those continuous or discontinuous points at or near (within +/−20% of the total surface area) the periphery of the surfaces 116, 122.

In one embodiment, the base 102 has a support plate 110 of a substantially rigid material (e.g., stainless steel, 6061 aluminum, etc.) and a vertical support leg 104 rotatably coupled to the support plate 110. The base 102 may also include a plurality of horizontal supports legs 106*a-n* coupled to the vertical support leg 104 and may each have a wheel 108 rotatably coupled thereto and defining a base support plane 118. In one embodiment, the vertical support leg 104 includes a plurality of telescopically connected leg components selectively vertically adjustable to one another with a lever (e.g., lever 200) coupled to the support plate 110. The assembly 100 may utilize multiple levers operably configured to vertically adjust the height of the overall assembly, the height and/or angle of the seat-support surface 116, the height and/or angle chest-support surface 122.

Figure 7:
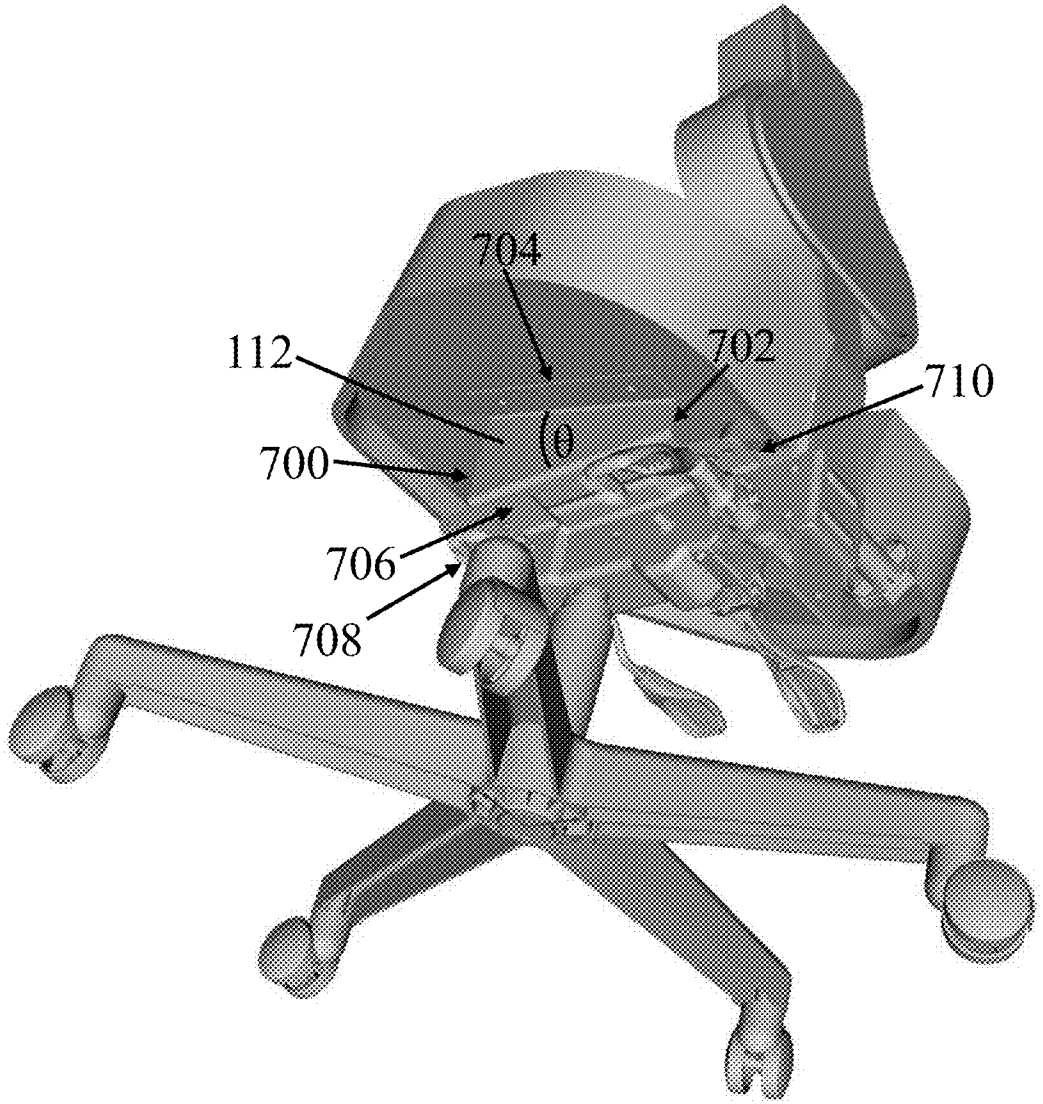
FIG. 7 is a perspective bottom view of the adjustable and angled seat assembly in FIG. 1.
Figure 8:
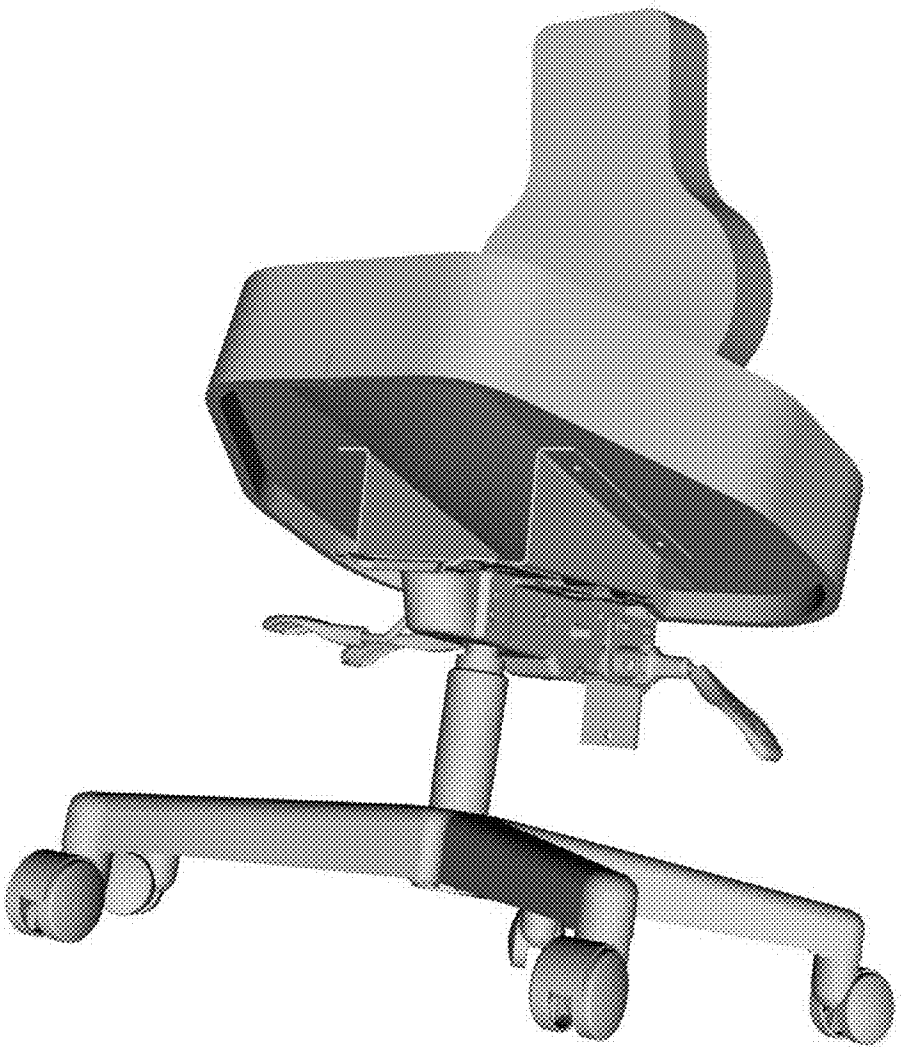
FIG. 8 is another perspective bottom view of the adjustable and angled seat assembly in FIG. 1.
Figure 9:
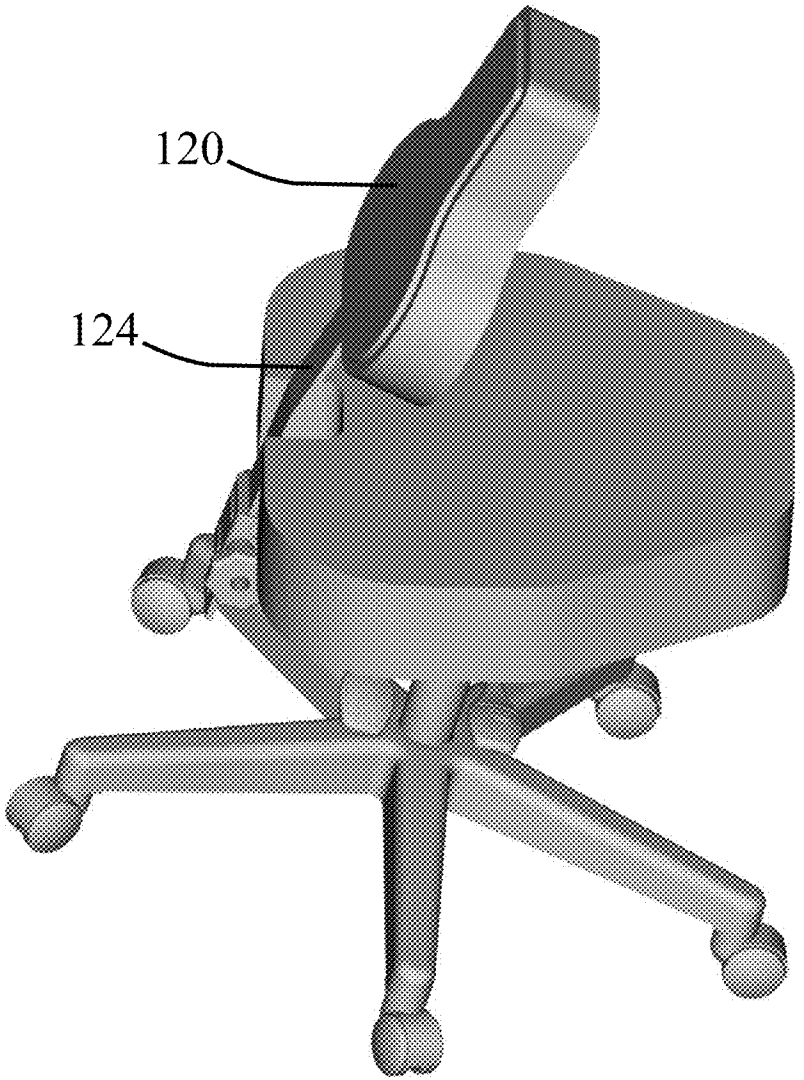
FIG. 9 is a perspective top view of the adjustable and angled seat assembly in FIG. 1.

With reference to FIG. 1 and FIG. 7, the assembly 100 beneficially includes a wedge support member 112 of a substantially rigid material, with a front end 700, a rear end 702 opposing the front end of the wedge support member 112, and a wedge length separating the front and rear ends 700, 702 of the wedge support member 112. The wedge support member 112 also includes an upper end 704, a lower end 706 opposing the upper end 704 of the wedge support member 112, and a wedge height separating the upper and lower ends 704, 706, wherein the lower end 706 of the wedge support member 112 is directly coupled to the support plate 110 and tapering in the wedge height spanning along the wedge length to define a wedge angle θ defined by the upper and lower ends 704, 706 of the wedge support member 112. In preferred embodiments, the wedge angle θ dictates and is substantially equal to the seat-support angle.

The assembly 100 beneficially includes a seat cushion member 114 having a seat-support surface 116 disposed above the base and a seat-support angle relative to the base support plane 118 and having a lower surface 300 opposing the seat-support surface 116 and directly coupled to the upper end 704 of the wedge support member 112. Further, the assembly also includes a chest cushion member 120 with a chest-support surface 122 disposed above the seat-support surface 116 and coupled to the support plate 110, wherein the chest-support surface 122 disposed at an acute angle with respect to the seat-support surface 116.

The seat-support surface 116 and the chest-support surface 122 may be made of the same or similar materials. In one embodiment, the cushion member 114 and the chest cushion member 120 are of a deformably resilient material. In one embodiment, the seat-support surface 116 and/or the chest-support surface 122 may be part of a soft or semi-firm cushion/material. Said differently, the seat cushion member 114 and the chest cushion member 120 are deformable to support the user thereon and provide user comfort. In another embodiment, the seat-support surface 116 and/or the chest-support surface 122 may be made of a polymer-based material. In other embodiments, the seat-support surface 116 and/or the chest-support surface 122 may be made of other types of materials known in the art for seats and other user-support members.

The seat-support surface 116 and the chest-support surface 122 are disposed and oriented at an acute angle, α, with respect to one another. Specifically, the surfaces 116, 122 can be described as being orientated, via a chest plane, at an acute angle with respect to a seating plane defined by the seat-support surface 116, such that the desired and/or proper user configuration is increasingly effectuated throughout positioning of the device. In one embodiment, the acute angle, α, is at most 80 degrees. In yet a further embodiment, the acute angle, α, is between 65 degrees and 85 degrees. In yet another embodiment and unless otherwise indicated, the acute angle, α, may be outside of these ranges. In one embodiment, the seat-support surface 116 and the chest-support surface 122 are fixed with respect to one another at the acute angle, α. As used herein, the term "fixed" is intended to indicate a coupling of the seat-support surface 116 to the chest-support surface 122 that is securely fastened in a permanent manner such that the angular orientation with respect to one another remains the same throughout any selective adjustments of other elements of the adjustable seating assembly 100. In other words, "fixed" indicates a coupling that is difficult to uncouple without special tools or without damaging the assembly 100. Stated yet another way, "fixed" is intended to indicate the opposite of "selectively adjustable." In embodiments where the seat-support surface 116 and the chest-support surface 122 are fixed with respect to one another, one advantage is the provision of proper spine support and orientation for the user, even if the user is unaware of the most optimal spine support sitting position. The wedge member 112 facilitates in creating that angle, α, in a structurally sound and effective manner.

In one embodiment, the entire surface of each of the seat-support surface 116 and the chest-support surface 122 is at an acute angle. In other embodiments, there may be portions of the surface of each of the seat-support surface 116 and the chest-support surface 122 that are not at an acute angle, but otherwise provide the user with a declining orientation with respect to the ground surface. Said another way, the user is oriented such that his or her weight is at least partially supported by the chest-support surface 112 when the assembly is in the operational position, which shows the user leaning slightly forward onto the chest-support surface 122. This orientation provides the user with not only comfort (or the alleviation of pain), but also with a posture that facilitates the rehabilitation of back pain and other orthopedic medical conditions.

In one embodiment, the chest-support surface 122 can be seen as disposed substantially upright with respect to the ground surface. As used herein, "substantially upright" is intended to indicate an angular orientation with respect to the ground surface (when the adjustable seating assembly 100 is in its operational position supported on the ground surface) that is 90 degrees (+/−15 degrees). In other embodiments, based on the user's desired positioning, the chest-support surface 106 may be disposed at other angles outside of 90 degrees (+/−15 degrees). As used herein, during any discussion herein of angular orientations or other configurations of elements of the adjustable seating assembly 100 with respect to other elements thereof or the ground surface, it is understood that the discussion pertains to the adjustable seating assembly 100 in its operational configuration for use the a user and supported on a planar ground surface, unless otherwise indicated, such as when the discussion clearly pertains to a collapsible storage configuration of the adjustable seating assembly 100. The substantially upright position of the chest-support surface 122 is in contrast with therapeutic chairs, which are typically designed to support the user in a substantially forward position at an obtuse angular orientation of a chest and seat support with respect to one another. As used herein, "substantially forward" is intended to indicate an angular orientation of the chest-support surface 122 with respect to the ground surface that is at most 65 degrees.

In one embodiment, the seat-support surface 116 can be seen as disposed and oriented at an acute angle, with respect to the ground surface. Said another way, the seat-support surface 116 would have an acute seat-support angle relative to a front end 128 of the seat cushion member 114 and the base support plane 118. In a further embodiment, the acute angle is at most 25 degrees with respect to the ground surface or base support plane 118. In yet a further embodiment, the acute angle, is at most 20 degrees with respect to the ground surface. In yet another embodiment and unless otherwise indicated, the acute angle, alpha, may be outside of these ranges.

An optimal angular orientation of the seat-support surface 116 and the chest-support surface 122 with respect to one another and/or with respect to the ground surface ensures optimal spine support and orientation for users, while also being free of any obstructions (e.g., donut face pillows) and being uniquely configured to allow such users to work at a desk area while sitting in the adjustable seating assembly 100. Importantly, when sitting in a regular office chair, the bottom of the pelvis is pushed forward and under, thereby eliminating the healthy "S-curve" of the normal spine and puts significant amounts of pressure on the lower spine.

When sitting in the adjustable seating assembly 100 of the present invention, the pelvis can be pushed back, leaving the natural S-curve of the spine and eliminating the stress related to sitting in conventional office chairs for a prolonged period of time. Instead of a seat back, the adjustable seating assembly may have padding that includes the chest-support surface 122, or "seat front." When desired for use, the user sits on the seat-support surface 116 (or "seat"), which may also include padding, and include padding, and sits while maintaining spinal alignment and posture, from the head down to the pelvis. The user may then adjusts the front support to provide gentle support to the stomach area. The chest-support surface 122 may include padding, and sits while maintaining spinal alignment and posture, from the head down to the pelvis. The user may adjust the front support to provide gentle support to the stomach area. The angle of the seat-support surface 116 (caused by the wedge member 112) and the chest-support surface 122, and therefore the angle from the ground in which the user sits, can be adjusted to be "laying" forward to the most comfortable angle, as can be seen in FIG. 1 and which will be discussed in more detail herein below. Said another way, the assembly may be adjusted to be upright, in the same position as when standing, or to be laying forward to provide support and relieve strain on the back when working on something in front of and/or below the user. Example of the second leaning forward position would be a dentist working on a patient, or a video game player. This adjustment allows the user to find the ideal angle for his pelvis to be situated, to allow for the optimal S-curve of his spine. This angle also disperses the user's body weight, alleviating pressure that normally compresses, strains, or stresses the lumbar/lower back.

The base 102 provides a stable ground support for the elements of the seating assembly 100 above the base 102, as well as, the user seated thereon. Accordingly, the seat-support surface 116 and the chest-support surface 122 are disposed above the base 102. In one embodiment, the base 102 is operably configured to lay flat on the ground surface for stable support thereon. In another embodiment, the base 102 may include casters or wheels for transportability.

Figure 3:
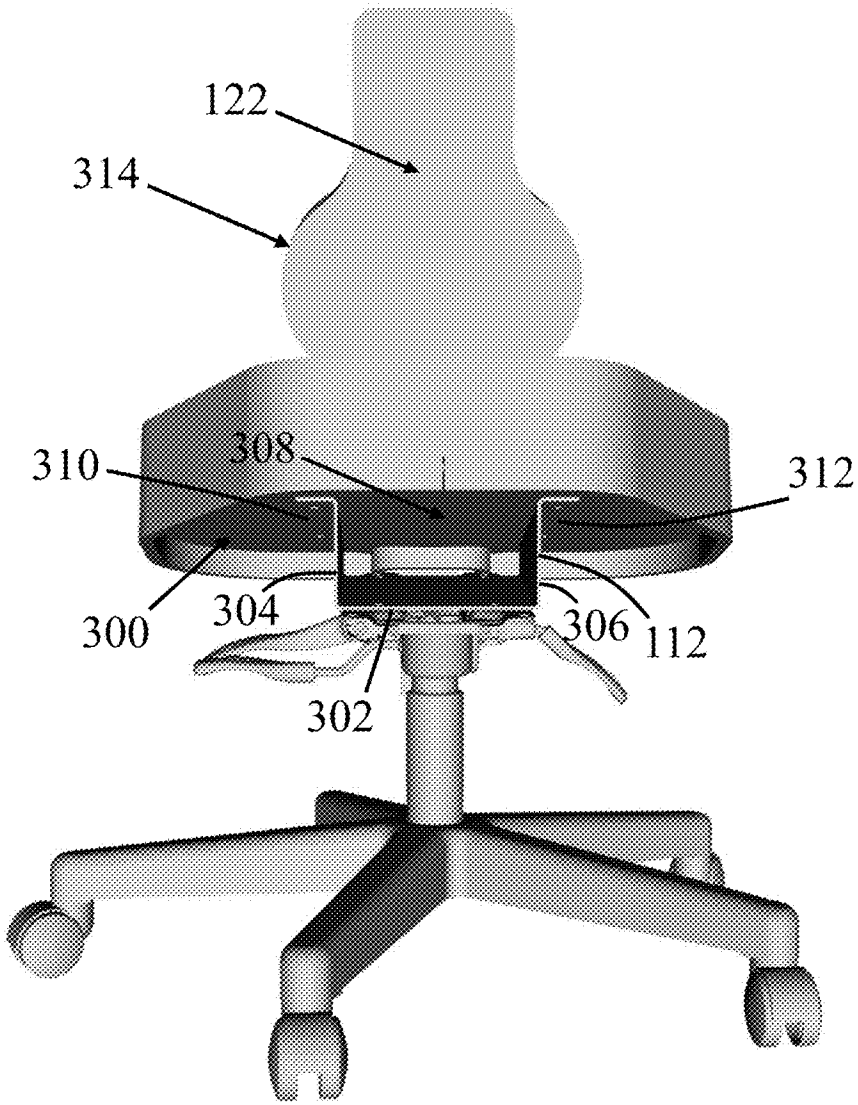
FIG. 3 is an elevational front view of the adjustable and angled seat assembly in FIG. 1.
Figure 4:
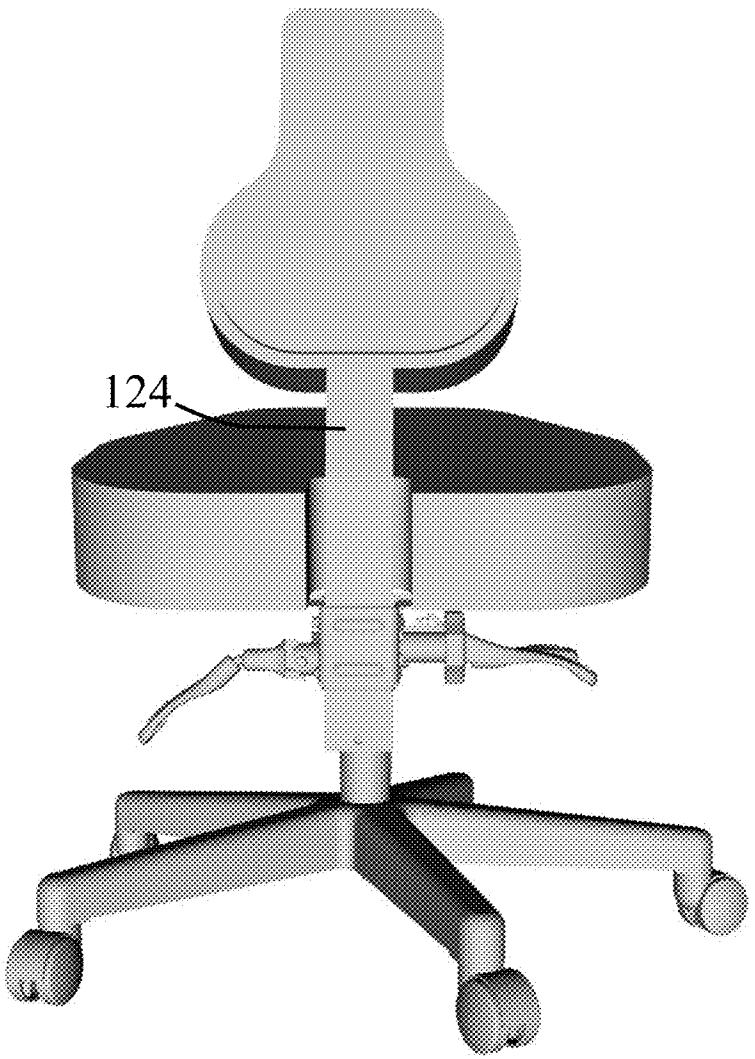
FIG. 4 is an elevational rear view of the adjustable and angled seat assembly in FIG. 1.
Figure 5:
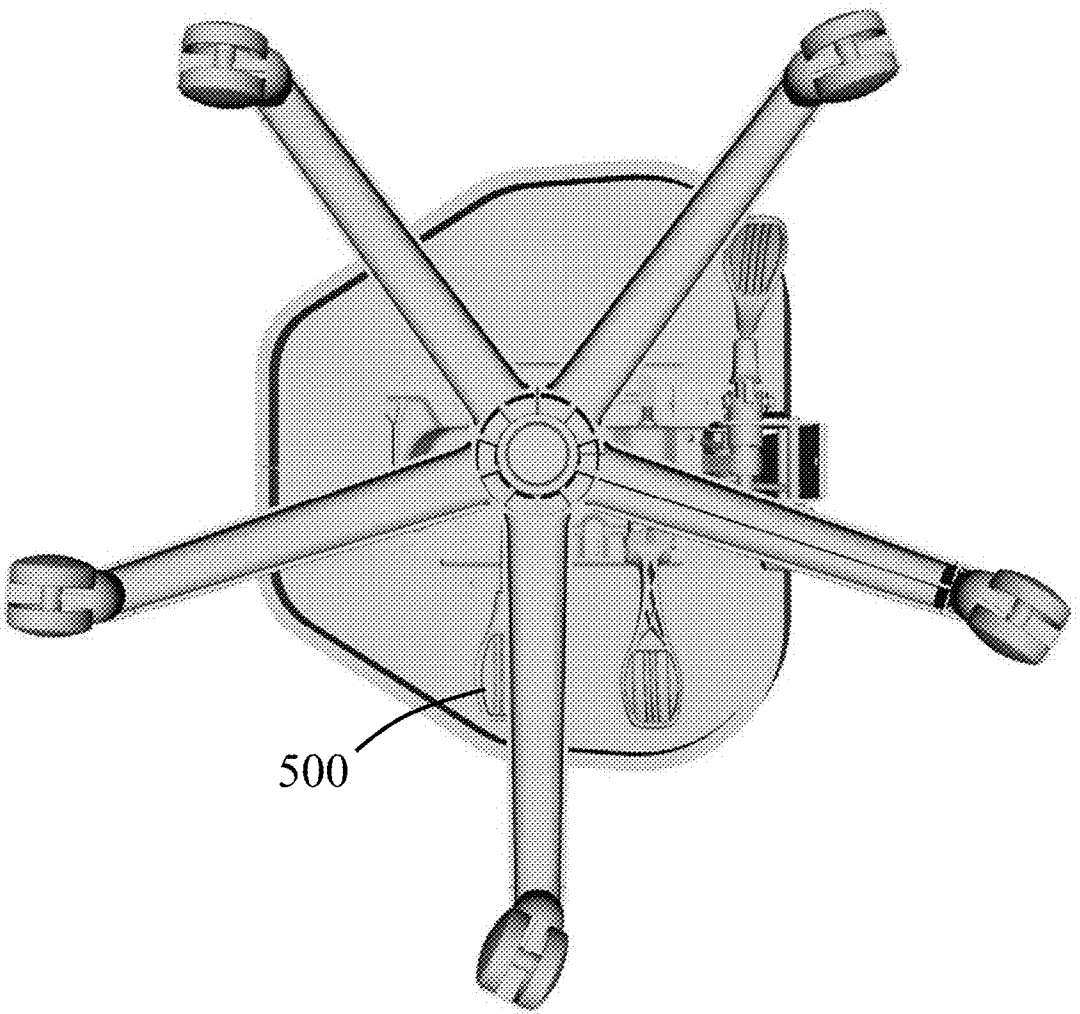
FIG. 5 is a bottom plan view of the adjustable and angled seat assembly in FIG. 1.
Figure 6:
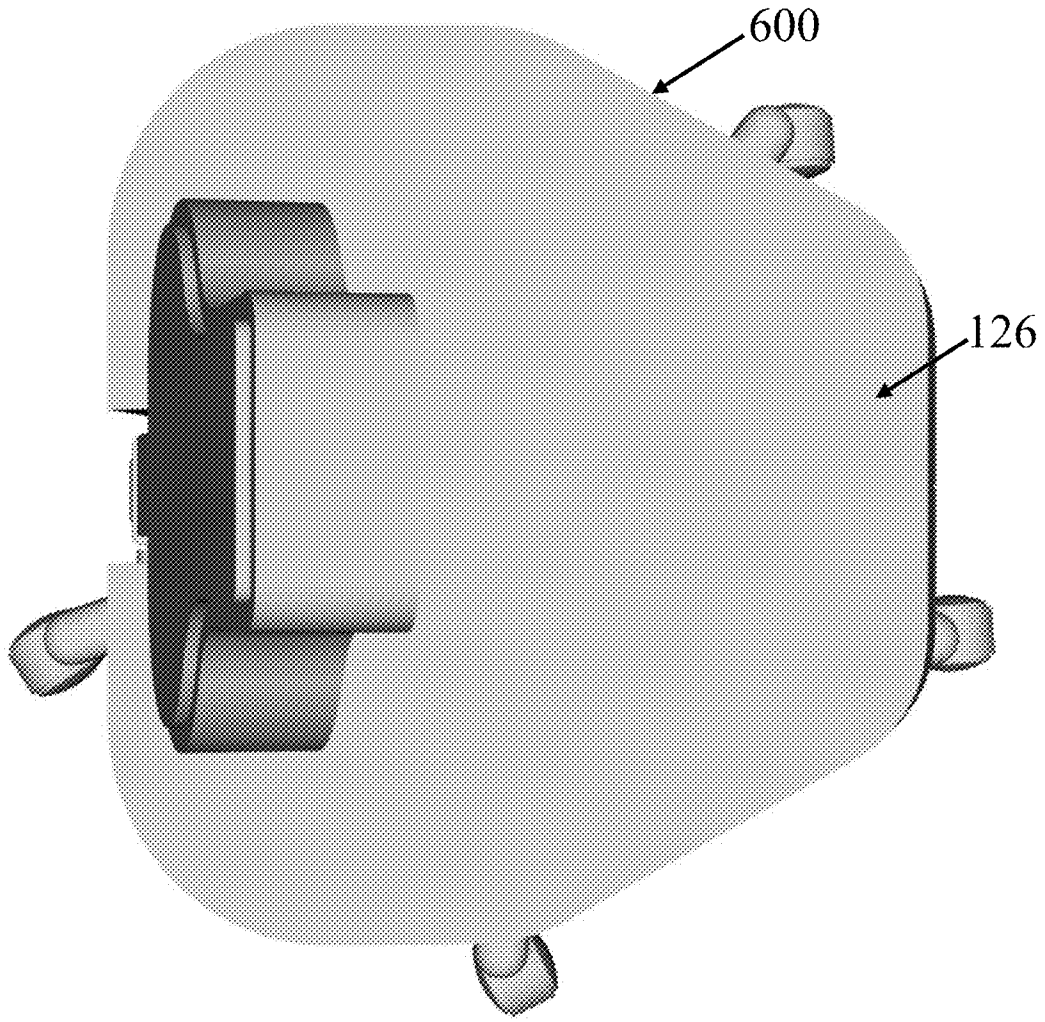
FIG. 6 is a top plan view of the adjustable and angled seat assembly in FIG. 1.

In one embodiment of the present invention, the chest cushion member 120 is selectively adjustable in height relative to the seat-support surface 116 with a chest support member 124 that is coupled to the support plate 110. With reference to FIG. 1, FIG. 3, and FIG. 6, the seat-support surface 116 may define and/or include peripheral user-contact points or edges 600 surrounding the seat-support surface 116 and define a seat plane. Furthermore, the chest-support surface 122 may define and/or include peripheral user-contact points or edges surrounding the chest-support surface 122 and that define a chest plane. The seat plane is orientated at an acute angle with respect to the chest plane as discussed above.

In one embodiment, the wedge support member 112 has a bottom wedge wall 302 spanning the wedge length and is flanked by two side wedge walls 304, 306 disposed in an upright configuration with respect to the bottom wedge wall 304, spanning the wedge length, and defining the wedge length. The wedge length may be approximately 2-12 inches depending on the design application and constraints. The bottom wedge wall 302 and the two side wedge walls 304, 306 may be beneficially of a plate-like configuration (as shown in the figures) to reduce weight and may define a wedge channel 308 spanning the wedge length. The wedge support member 112 may also include a first cantilevered flange member 310 extending outwardly from one of the two side wedge walls 304, 306 and a second cantilevered flange member 312 extending outwardly from another of the two side wedge walls 304, 306. The cantilevered flange members 310, 312 may be also of a plate-like configuration and may define a planar support surface for coupling with the seat cushion member 114. The first and second cantilevered flange members 310, 312 may extend outwardly from the side wedge walls a length of approximately 1-2 inches. The cantilevered flanges could also extend in too, if used with different bolt patterns. The first and second cantilevered flange members 310, 312 are beneficially disposed in a parallel and adjacent configuration with the lower surface 300 of the seat cushion member 114 and coupled thereto with a plurality of fasteners (e.g., bolts, screws, adhesive, etc.) to provide a structurally sound and stable assembly generating the acute angle discussed herein.

In one embodiment, the support plate 110 utilized with the assembly includes an upper surface 126, wherein the bottom wedge wall 302 is disposed in a parallel and adjacent configuration with the upper surface 126 of the support plate 110 and coupled thereto with a plurality of fasteners. In further embodiments, the support plate 110 also includes a support front end 708, a support rear end 710 opposing the support front end 708, and a support length separating the support front and rear ends 708, 710, wherein the upper surface 126 spans the support length and the bottom wedge wall 302 is directly coupled to the upper surface 126 along at least 75% of the support length. The structural configuration and placement of the support plate 110 and wedge member 112 facilitates generating a structurally sound and stable assembly generating the acute angle discussed herein. As used herein, the term "substantially parallel" is intended to indicate 0 degrees (+/−15 degrees). As used herein, the term "contact" is defined as touching. As used herein, the term "substantially perpendicular" is intended to indicate 90 degrees (+/−15 degrees).

An adjustable and angled seat assembly has been disclosed that provides a novel and efficient adjustable seating assembly. Embodiments of the invention provide an adjustable seating assembly with a chest-support surface orientated at an acute angle with respect to a seat-support surface utilizing a wedge that makes the overall assembly structural sound. In addition, the assembly is operable to be freely mobile and adjustable while generating the acute angle discussed herein.

What is claimed is:

1. An adjustable and angled seat assembly comprising:

a base having a support plate of a substantially rigid material and having a vertical support leg rotatably coupled to the support plate and with a plurality of horizontal supports legs coupled to the vertical support leg and each having a wheel rotatably coupled thereto and defining a base support plane;

a wedge support member of a substantially rigid material, with a front end, a rear end opposing the front end of the wedge support member, a wedge length separating the front and rear ends of the wedge support member, an upper end, a lower end opposing the upper end of the wedge support member, and a wedge height separating the upper and lower ends, the lower end of the wedge support member directly coupled to the support plate and tapering in the wedge height spanning along the wedge length to define a wedge angle (θ) defined by the upper and lower ends of the wedge support member;

a seat cushion member having a seat-support surface disposed above the base and a seat-support angle relative to the base support plane and having a lower surface opposing the seat-support surface and directly, non-adjustably, and fixedly coupled to the upper end of the wedge support member with one or more fasteners; and a chest cushion member having a chest-support surface disposed above the seat-support surface and coupled to the support plate, the chest-support surface disposed at an acute angle with respect to the seat-support surface.

2. The adjustable and angled seat assembly according to claim 1, wherein the vertical support leg further comprises a plurality of telescopically connected leg components selectively vertically adjustable to one another with a lever coupled to the support plate.

3. The adjustable and angled seat assembly according to claim 1, wherein the wedge angle (θ) is substantially equal to the seat-support angle.

4. The adjustable and angled seat assembly according to claim 1, wherein the cushion member and the chest cushion member are of a deformably resilient material.

5. The adjustable and angled seat assembly according to claim 1, wherein the chest cushion member is selectively adjustable in height relative to the seat-support surface with a chest support member and coupled to the support plate.

6. The adjustable and angled seat assembly according to claim 1, further comprising:

peripheral user-contact edges surrounding the seat-support surface and defining a seat plane; and peripheral user-contact edges surrounding the chest-support surface and defining a chest plane, the seat plane orientated at an acute angle with respect to the chest plane.

7. The adjustable and angled seat assembly according to claim 1, wherein the wedge support member further comprises:

a bottom wedge wall spanning the wedge length and flanked by two side wedge walls disposed in an upright configuration with respect to the bottom wedge wall, spanning the wedge length, and defining the wedge length, the bottom wedge wall and the two side wedge walls defining a wedge channel spanning the wedge length.

8. The adjustable and angled seat assembly according to claim 7, wherein the wedge support member further comprises:

a first cantilevered flange member extending outwardly from one of the two side wedge walls and a second cantilevered flange member extending outwardly from another of the two side wedge walls, wherein the first and second cantilevered flange members are disposed in a parallel and adjacent configuration with the lower surface of the seat cushion member and coupled thereto with a plurality of fasteners.

9. The adjustable and angled seat assembly according to claim 7, wherein the support plate further comprises:

an upper surface, the bottom wedge wall disposed in a parallel and adjacent configuration with the upper surface of the support plate and coupled thereto with a plurality of fasteners.

10. The adjustable and angled seat assembly according to claim 9, wherein the support plate further comprises:

a support front end, a support rear end opposing the support front end, and a support length separating the support front and rear ends, wherein the upper surface spans the support length and the bottom wedge wall is directly coupled to the upper surface along at least 75% of the support length.

11. An adjustable and angled seat assembly comprising:

a base having a support plate of a substantially rigid material;

a wedge support member with a front end, a rear end opposing the front end of the wedge support member, a wedge length separating the front and rear ends of the wedge support member, an upper end, a lower end opposing the upper end of the wedge support member, a wedge height separating the upper and lower ends, a bottom wedge wall spanning the wedge length and flanked by two side wedge walls disposed in an upright configuration with respect to the bottom wedge wall, spanning the wedge length, a first cantilevered flange member extending outwardly from one of the two side wedge walls, a second cantilevered flange member extending outwardly from another of the two side wedge walls, and defining the wedge length, the bottom wedge wall and the two side wedge walls defining a wedge channel spanning the wedge length, the bottom wedge wall directly coupled to the support plate and tapering in the wedge height spanning along the wedge length to define a wedge angle n defined by the upper and lower ends of the wedge support member and the first and second cantilevered flange members disposed in a parallel and adjacent configuration with the lower surface of the seat cushion member and coupled thereto with a plurality of fasteners;

a seat cushion member having a seat-support surface disposed above the base and having a lower surface opposing the seat-support surface and directly coupled to the upper end of the wedge support member; and a chest cushion member having a chest-support surface disposed above the seat-support surface and coupled to the support plate, the chest-support surface disposed at an at an acute angle with respect to the seat-support surface.

12. The adjustable and angled seat assembly according to claim 11, wherein the chest cushion member is selectively adjustable in height relative to the seat-support surface with a chest support member and coupled to the support plate.

13. An adjustable and angled seat assembly according to claim 11, wherein the base further comprises:

a base having a vertical support leg rotatably coupled to the support plate and with a plurality of horizontal supports legs coupled to the vertical support leg and each having a wheel rotatably coupled thereto and defining a base support plane.

14. The adjustable and angled seat assembly according to claim 13, wherein the seat cushion member further comprises:

a seat-support surface having an acute seat-support angle relative to a front end of the seat cushion member base and the support plane.

15. The adjustable and angled seat assembly according to claim 14, wherein the wedge angle (θ) is substantially equal to the seat-support angle.

16. The adjustable and angled seat assembly according to claim 11, wherein the support plate further comprises:

an upper surface, the bottom wedge wall disposed in a parallel and adjacent configuration with the upper surface of the support plate and coupled thereto with a plurality of fasteners.

17. The adjustable and angled seat assembly according to claim 1, wherein the cushion member and the chest cushion member are of a deformably resilient material.

18. The adjustable and angled seat assembly according to claim 1, further comprising:

peripheral user-contact points surrounding the seat-support surface and defining a seat plane; and peripheral user-contact points surrounding the chest-support surface and defining a chest plane, the seat plane orientated at an acute angle with respect to the chest plane.

19. An adjustable and angled seat assembly comprising:

a base having a support plate of a substantially rigid material and having a vertical support leg rotatably coupled to the support plate and with a plurality of horizontal supports legs coupled to the vertical support leg and each having a wheel rotatably coupled thereto and defining a base support plane;

a wedge support member of a substantially rigid material, with a front end, a rear end opposing the front end of the wedge support member, a wedge length separating the front and rear ends of the wedge support member, an upper end, a lower end opposing the upper end of the wedge support member, a bottom wedge wall spanning the wedge length and flanked by two side wedge walls disposed in an upright configuration with respect to the bottom wedge wall, spanning the wedge length, and defining the wedge length, and a wedge height separating the upper and lower ends, the lower end of the wedge support member directly coupled to the support plate and tapering in the wedge height spanning along the wedge length to define a wedge angle (θ) defined by the upper and lower ends of the wedge support member and the bottom wedge wall and the two side wedge walls defining a wedge channel spanning the wedge length;

a seat cushion member having a seat-support surface disposed above the base and a seat-support angle relative to the base support plane and having a lower surface opposing the seat-support surface and directly coupled to the upper end of the wedge support member; and a chest cushion member having a chest-support surface disposed above the seat-support surface and coupled to the support plate, the chest-support surface disposed at an acute angle with respect to the seat-support surface.

* * * * *